US005827399A

United States Patent [19]

Neittaanmäki et al.

[11] Patent Number: 5,827,399

[45] Date of Patent: Oct. 27, 1998

[54] METHOD AND SYSTEM FOR REGULATION AND ON-LINE MEASUREMENT OF THE FIBRE ORIENTATION IN A WEB PRODUCED BY A PAPER MACHINE

[75] Inventors: Pekka Neittaanmäki; Erkki Laitinen, both of Jyväskylä ; Tapani Miinalainen, Vesanka; Pekka Pakarinen; Jouni Koskimies, both of Jyväskylä , all of Finland

[73] Assignee: Valmet Paper Machinery Inc., Helsinki, Finland

[21] Appl. No.: 147,455

[22] Filed: Nov. 5, 1993

Related U.S. Application Data

[63] Continuation of Ser. No. 821,430, Jan. 15, 1992, abandoned, which is a continuation of Ser. No. 553,726, Jul. 16, 1990, abandoned.

[30] Foreign Application Priority Data

Jul. 17, 1989 [FI] Finland ..... 893461

[51] Int. Cl.[6] ..... D21F 11/00

[52] U.S. Cl. ..... 162/198; 162/DIG. 11

[58] Field of Search ..... 162/DIG. 11, 198, 162/252, 259, 262, 263, 257, DIG. 10; 364/471.02, 568

[56] References Cited

U.S. PATENT DOCUMENTS

| | | |
|---|---|---|
| 3,556,935 | 1/1971 | Amneus et al. . |
| 3,573,160 | 3/1971 | Lopas . |
| 3,666,621 | 5/1972 | Adams . |
| 4,087,321 | 5/1978 | Schultz et al. . |
| 4,089,739 | 5/1978 | Hildebrand et al. . |
| 4,137,124 | 1/1979 | Bubik et al. . |

(List continued on next page.)

FOREIGN PATENT DOCUMENTS

| | | |
|---|---|---|
| 363776 | 8/1981 | Austria . |
| 0041486 A1 | 5/1981 | European Pat. Off. . |
| 833645 | 5/1983 | Finland . |
| 2151906 | 4/1973 | Germany . |
| 1216114 | 12/1970 | United Kingdom . |
| 8228998 | 10/1982 | United Kingdom . |
| 8303614 | 2/1983 | United Kingdom . |

OTHER PUBLICATIONS

Grossman, Stanley I., *Applications for Elementary Linear Algebra,* Wadworth Publishing Company, Belmont, California, 1980, pp. 1–5.

Grossman, Stanley I., *Elementary Linear Algebra,* Wadsworth Publishing Company, Belmont, California, 1980, pp. 1–2, 6–8, 13–14.

(List continued on next page.)

*Primary Examiner*—Brenda A. Lamb

*Attorney, Agent, or Firm*—Cohen, Pontani, Lieberman & Pavane

[57] ABSTRACT

A method for regulation of the transverse distribution of the fiber orientation of a web produced by means of a paper machine or equivalent, by regulating the transverse profile of the discharge opening (16) of the headbox (10) of the paper machine. The transverse grammage profile of the paper web ($W_0 \ldots W_1$) produced by means of the paper machine is measured, and the measurement signal obtained in this way is used as a feedback signal in the control system. With the machine configuration and parameters present in the paper machine to be controlled, data are collected concerning the relationship between the directional angle of the transverse distribution of fiber orientation and the transverse distribution of grammage of the web ($W_0 \ldots W_1$) that is being produced by, carrying out response runs of the paper machine in its various states of operation (i). The relation data are stored in the memory of the computer (52). By making use of the relation data, the distribution of fiber orientation in the web ($W_0 \ldots W_1$) to be produced is corrected by regulating the transverse profile of the discharge opening (16) of the headbox (10). Moreover, a corresponding method for on-line measurement of the fiber orientation is described.

20 Claims, 8 Drawing Sheets

U.S. PATENT DOCUMENTS

| | | | |
|---|---|---|---|
| 4,374,703 | 2/1983 | Lebeau et al. | 162/253 |
| 4,500,968 | 2/1985 | Bialkowski | 364/471 |
| 4,526,654 | 7/1985 | Johansson et al. | 162/259 |
| 4,680,089 | 7/1987 | Aral et al. | 162/198 |
| 4,707,779 | 11/1987 | Hu | 364/148 |
| 4,748,400 | 5/1988 | Typpo . | |
| 4,792,380 | 12/1988 | Tuomikoski | 162/344 |
| 4,874,467 | 10/1989 | Karlsson et al. | 162/198 |
| 4,888,094 | 12/1989 | Weisshuhn et al. | 162/259 |
| 4,892,623 | 1/1990 | Reed | 162/336 |
| 4,927,499 | 5/1990 | Wikman | 162/336 |
| 4,947,684 | 8/1990 | Balakrishnan | 73/159 |
| 4,955,720 | 9/1990 | Blecha et al. | 356/429 |
| 4,957,770 | 9/1990 | Howarth | 427/9 |

OTHER PUBLICATIONS

Grossman, Stanley I. *Finite Mathematics: with Applications to Business, Life Sciences, and Social Sciences,* Wadsworth Publishing Company, Belmont, California, 1983, p. 57.

Oppenheim, Alan V., Schafer, Ronald W., *Digital Signal Processing,* Prentice–Hall, N.J. (1975). pp. 6–35.

Stanley, William D., Dougherty, Gary R., Dougherty, Ray, *Digital Signal Processing, 2d Ed.,* Reston Pub. Co. (1984) pp. 38–56.

Casey, James P., *Pulp and Paper Chemistry and Chemical Technology, vol. 2, 3d Ed.,* John Wiley & Sons (1980) pp. 1025–1029.

Carroll, Charles W., "Computer Control of the Kraft Fourdrinier Linerboard Machine", *Paper Trade Journal,* Sep. 10, 1962. pp. 42–45.

Siler, Steven J., "Cross–machine basis–weight control: machine considerations", 872 *Tappi Journal* 67, No. 12 (Dec. 1984), pp. 52–55.

METHOD AND SYSTEM FOR REGULATION AND ON-LINE MEASUREMENT OF THE FIBRE ORIENTATION IN A WEB PRODUCED BY A PAPER MACHINE

This application is a continuation of application Ser. No. 07/821,430 filed Jan. 15, 1992, now abandoned, which is a continuation of application Ser. No. 07/553,726 filed Jul. 16, 1990, now abandoned.

BACKGROUND AND SUMMARY OF THE INVENTION

The invention concerns a method and system for regulation of the transverse distribution of the fibre orientation of a web produced by means of a paper machine or equivalent, wherein the transverse profile or equivalent of the discharge opening of the headbox of the paper machine is regulated, the transverse grammage profile of the paper web produced by means of the paper machine is measured, and wherein the measurement signal obtained in this way is used as a feedback signal in the control system that carries out the method.

The invention further concerns a method for on-line measurement of the transverse distribution of the fibre orientation in a web produced by means of a paper machine or equivalent, in which method the transverse grammage profile of the web, produced by means of a paper machine, is measured.

As is known in the prior art, a pulp suspension jet is fed out of the discharge opening in paper or board machines onto the forming wire or into the gap between forming wires. The transverse profile of the discharge opening of the headbox also determines the profile of the pulp jet. The profile of the discharge opening is regulated, and by means of this regulation it is partly possible also to compensate for the flaws in the pulp jet that have arisen in or before the headbox.

In the prior art, a system for control of the grammage profile of the headbox of a paper machine is known, said system comprising an angle-gear/stepping-motor actuator, by which the profile bar of the regulating lip is controlled by means of regulation spindles attached to the bar at distances of about 10–15 cm, said spindles being displaced by said actuator engaged at the opposite ends of each of said spindles. As a rule, the profiling of the profile bar of the discharge opening in the headbox takes place by separately controlling each regulation gear by means of a successive handling sequence. In order that the positioning is carried out successfully with the required precision of about 10 $\mu$m, an electronic system for measurement of the locations of the regulation spindles is also needed.

As is known in the prior art, for the discharged flow of the pulp suspension out of the headbox, a uniform distribution of velocity in the transverse direction of the paper machine is sought. However, in said flow, a detrimentally high transverse velocity may occur. Particularly in the lateral areas of the web this high velocity is detrimental, in that it for example, results in the formation of increased waves at the edges. The distribution of velocities mentioned above must be within certain limits in order to achieve production of paper which is sufficiently homogeneous across the entire width of the web with respect to grammage, formation and strength properties and that has a minimum proportion at the edges of the web that need to be cut off.

Some laser printing methods which were developed in recent years, such as sheet-heating copying and continuous-form heating copying, have imposed ever higher and even partly new requirements on the uniformity of the structure of fine paper to be printed by means of these methods. This is mainly due to the very rapid and intensive heating of the sheet which takes place during the printing process. A considerable requirement is imposed in that the orientation of the main axes of the directional distribution of the fibre mesh in the paper should coincide with the directions of the main axis of the paper and the orientation should be symmetric relative to these axes.

Regulation of fibre orientation and of its distribution should be understood herein to mean regulation of the direction of the orientation of the main axis.

The above problems have been thoroughly studied by the inventor. As a result therefore it has been possible to establish that the symmetry required from the fibre orientation requires that, in the discharge jet, a transverse velocity of about 2 to 3 cm/s in a direction transverse to the web must not be exceeded in any part of the web. Since the transverse velocity already arises in the discharge duct along with attenuation of an uneven main flow profile, the main attention must be directed towards establishing uniformity of the profile of velocity in the flow direction after the turbulence generator. Even if it were possible to perfectly dimension the distribution system in the headbox and even if said distribution system and the turbulence generators could be manufactured so accurately that the imposed requirement is met, an apparatus manufactured in this way would become commercially unprofitable because of its high cost.

Partly as a result of the studies conducted by the inventor, one critical quality factor of fine paper suitable for laser printing is the deviation of the main axis of the directional distribution of the fibres in the paper from the manufacturing direction, i.e. the so-called distortion of the fibre orientation.

The flaws in the fibre orientation are produced from faults in the flow of the pulp suspension at the wet end of the paper as well as, secondarily, out of the drying shrinkage of the paper web, which increases towards the edges of the web in the drying section. So far, it has not been possible to correct the faults in the fibre orientation by means of any on-line regulation method. One difficulty already consists of reliable on-line measurement of the fibre orientation directly from the paper web.

Besides affecting quality for laser printing on the paper produced, the transverse flow that produces a distortion of the fibre orientation also has an effect on other quality factors, such as on the anisotropy of strength and elongation. The level of anisotropy and its variation in the transverse direction also affect the printing properties of the paper, in particular color alignment. When color printing, the paper becomes moist and stretches and/or contracts in a varying way, which may cause defects in color alignment during the printing process.

The flaws in the fibre orientation in a paper web arise primarily from the following factors. A smaller amount of pulp flows at the edges of the pulp flow duct in the headbox. This "edge effect" causes a very strong linear distortion in the profile. Profile flaws in the turbulence generator of the headbox usually produce a non-linear distortion in the profile inside the lateral areas of the flow ducts. An acceleration produced in the discharge cone in the headbox evens the profile flaws in the main flow, but it is exactly that phenomenon that produces the transverse flow.

Flaws of orientation in a paper web are also produced indirectly out of the operation of the drying section, because when the paper becomes dry, it can shrink in the transverse direction unevenly so that the lateral areas shrink considerably more than the middle area. Attempts are made to compensate for the unevenness of grammage profile produced by the drying shrinkage by cambering the discharge opening so that the discharge opening is thicker at the middle of the pulp jet. However, this results in transverse flows in the discharge jet and further on the wire part, which again causes distortion of the fibre orientation. The same phenomenon also affects the transverse strength profiles of the web.

In the applicant's published FI Patent Applications Nos. 75,377 and 70,616 (corresponding U.S. Pat. No. 4,687,548) a method is described for controlling the distortion of the fibre orientation of a paper web, in that method, flows of medium are passed to both of the opposite lateral parts of the flow duct in the headbox, so that the distortion of the fibre orientation is controlled. The flows of medium consist of pulp suspension flows, which are passed into the lateral passages placed facing the turbulence generator, which is placed ahead of the slice part of the headbox in the direction of flow in the headbox. The magnitude and/or mutual proportion of the pulp suspension flows are regulated to control the distortion of the fibre orientation caused by said flows, by producing a transverse flow speed in the discharge flow in the headbox. This transverse flow speed compensates for some of the distortion of the fibre orientation. The by-pass flows of pulp suspension are regulated by means of regulation valves fitted in the by-pass flow pipes.

In the applicant's FI Patent Application No. 884408 (filed Sep. 26, 1988) a method is described, in the headbox of a paper machine, for controlling the distribution of the fibre orientation in the paper web in the transverse direction of the machine, in which method the transverse speed component of the discharge jet is regulated, said transverse speed component being controlled by regulating the alignment of the turbulence pipes in the pipe battery of the turbulence generator in the headbox.

In the applicant's FI Patent Application No. 884382 (filed Sep. 23, 1988), a regulation method in the headbox of a paper machine is described, for controlling the distortion of the fibre orientation of a paper web, in which flows of medium are passed to both the opposite lateral parts of the flow duct in the headbox, whereby the distortion of the fibre orientation is controlled, said flows of medium consist of pulp suspension flows, which are regulated by means of regulation pumps fitted in their flow ducts. The regulation pumps are, e.g., pulp pumps of adjustable speed of rotation.

Under the prior art methods for controlling the fibre orientation in a paper web, it is possible to control linear distortion profiles only. Indeed, the prior art methods are suitable for the control of the fibre orientation, but, when they are used, often after a large non-linear residual error remains as compared with a uniform distribution of the orientation. It is advisable to use these prior art methods for basic regulation of the distortion of the orientation, whereas the method in accordance with the present invention is intended to be suitable for compensation of said residual error.

An important starting point of the invention has been the observation that the transverse speed components occurring in the discharge jet have an effect both on the grammage profile and on the fibre orientation profile. An adjustment of a lip in the headbox also produces an alteration in the transverse flows in the pulp jet even though the purpose of such an adjustment is to act upon the grammage profile, i.e. on the thickness profile of the pulp layer that is fed. The transverse flows have a direct relationship to the distribution of the fibre orientation. On adjustment, both the grammage profiles and the fibre orientation profiles are changed.

A main object of the present invention is to provide a novel method for on-line measurement and regulation of the fibre orientation by which most of the drawbacks discussed above are avoided.

A particular object of the present invention is to provide such a method for regulation of the fibre orientation by which it is possible to produce a fine paper of better laser printable quality and, if necessary, also a paper whose anisotropies in respect of other quality properties are smaller and, in the transverse direction, more uniform.

A further object of the invention is to provide a reliable method for on-line measurement of the fibre orientation directly from the paper web, by which it is possible to carry out regulation of the orientation, if necessary, even manually and empirically.

Another object of the invention is to provide a microcomputer-based regulation package which can be implemented readily in the control systems of existing paper machines.

An additional object of the present invention is to provide a method for regulation and measurement of the fibre orientation and a related computer software system that is sufficiently rapid to carry out real-time regulation and/or on-line measurement of orientation. The software related to the invention is preferably prepared such that it can be utilized in a microcomputer-based environment so that it is easy for the operating personnel to learn to use the method of the invention.

In order to achieve the objects of the present invention, the regulation method and system of the invention is characterized in that such method and system comprises a combination of the following steps carried out in the sequence given:

(a) while controlling the machine configuration and parameters at each particular time and state of operation in the paper machine, data is collected concerning the relationship between the transverse distribution of fibre orientation and the transverse distribution of grammage of the web produced by the paper machine, by carrying out response runs in its various states of operation.

(b) the relation data obtained in the stage (a) specified above is stored in the memory of the computer or equivalent included in the control system of the paper machine, and (c) by making use of said relation data, by means of the control system, the distribution of fibre orientation in the web to be produced is corrected by regulating the transverse profile of the discharge opening of the headbox or equivalent.

On the other hand, the method in accordance with the invention for on-line measurement of fibre orientation comprises a combination of the following steps carried out in the sequence given:

(a) with the machine configuration and parameters at each particular time present in the paper machine, data is collected concerning the relationship between the transverse distribution of fibre orientation and the transverse distribution of grammage of the web that is being produced by the paper machine, by carrying out response runs in its various states of operation.

(b) the relation data obtained in the stage (a) specified above is stored in the memory of the computer or equivalent included in the control system of the paper machine, and (c) by making use of said relation data, the distribution of the fibre orientation in the web is expressed on the basis of measurement of the transverse grammage profile of the paper web.

The invention is based on the observation that there is a distinct relationship between the changes in the transverse distribution of the fibre orientation in the paper web and the changes in the distribution of grammage, and that this relationship may be utilized in a novel way. Said relationship between the distribution of orientation and the distribution of grammage is highly paper-machine specific, and the relationship depends primarily on the constructions of the headbox and of the former part. Secondarily, said relationship depends on the species and quality of the paper that is being produced, based on parameters such as fibre material, grammage level, and machine speed.

In the regulation method in accordance with the invention, the transverse distribution of the fibre orientation in the paper web is controlled by measuring the transverse grammage profile of the web and by adjusting the profile-bar adjustment spindles or other, equivalent actuators in the headbox. In the regulation method in accordance with the invention, it is, as a rule, unnecessary to regulate the additional feed valves or pumps mentioned in the applicant's FI patents and applications mentioned above, but said valves or pumps may, however, be employed alongside the present invention for alignment of the linear profile of a distortion of orientation.

In the invention, in order to determine the relationship between the fibre orientation and the grammage at each particular time, response runs are carried out, wherein the distribution of the fibre orientation is measured in the laboratory by taking samples from the web that is produced, the fibre orientations being determined from said samples with sufficiently dense spacing in the transverse direction of the web, by means of prior art commercial laboratory measurement methods and devices, the DFS-method (see FI Patent 75,054, Koskimies et Lepistö), or tests of diagonal tensile strength. Such a large number of response runs and related series of laboratory measurements are performed such that, by calculating the average values of the measurement results, a sufficiently good correlation is obtained between the grammage profile and the fibre-orientation profile. As a rule, a correlation coefficient of about 80% is sufficient.

When a substantially even transverse profile of fibre orientation is accomplished by means of the method of the invention, one still has to be content with a somewhat incomplete evenness of the grammage profile, but, as a rule, an even profile of fibre orientation can be accomplished with a sufficiently even grammage profile.

The grammage profile does not necessarily always deteriorate when the orientation profile is correct, but the correction effects are at least partly parallel.

In the implementation of the invention it is preferable that the grammage and fibre-orientation profiles are displayed at the work station of an operator who performs the regulation and measurement methods of the invention, so that the success of the regulation can be noticed immediately and, if necessary, particular action can be taken, for example, new response runs can be performed when a change occurs in the paper quality produced, and the machine speed, and/or other process parameters that affect the relationship between the distributions of grammage and fibre orientation can be changed.

As to the system of control of the paper machine which is applied in connection with the present invention and by whose means the transverse property profiles of the web to be produced are regulated, this system may be, e.g., similar to that described in the applicant's FI Patent application No. 892670 (filed Jun. 1, 1989) or equivalent.

Though the terms "paper web" and "paper machine" are used herein, these phrases are to be understood to also refer to board webs and board machines.

BRIEF DESCRIPTION OF THE DRAWING FIGURES

The invention will be described below in detail with reference to some preferred and exemplifying embodiments illustrated in the accompanying drawings. It is to be understood that the invention is in no way strictly confined to the details of said embodiments.

In the drawing figures, FIG. 1 is partly an axonometric illustration of the principle and partly a block diagram of the method in accordance with the invention and of the related system for regulation of grammage and of an adjustable headbox of a paper machine.

FIGS. 2G, 2H, 2I and 2J show some typical grammage and fibre-orientation profiles occurring in connection with performing the step of regulating the fibre-orientation profile in accordance with the invention.

DETAILED DESCRIPTION OF THE PREFERRED EMBODIMENT

Figure 1:
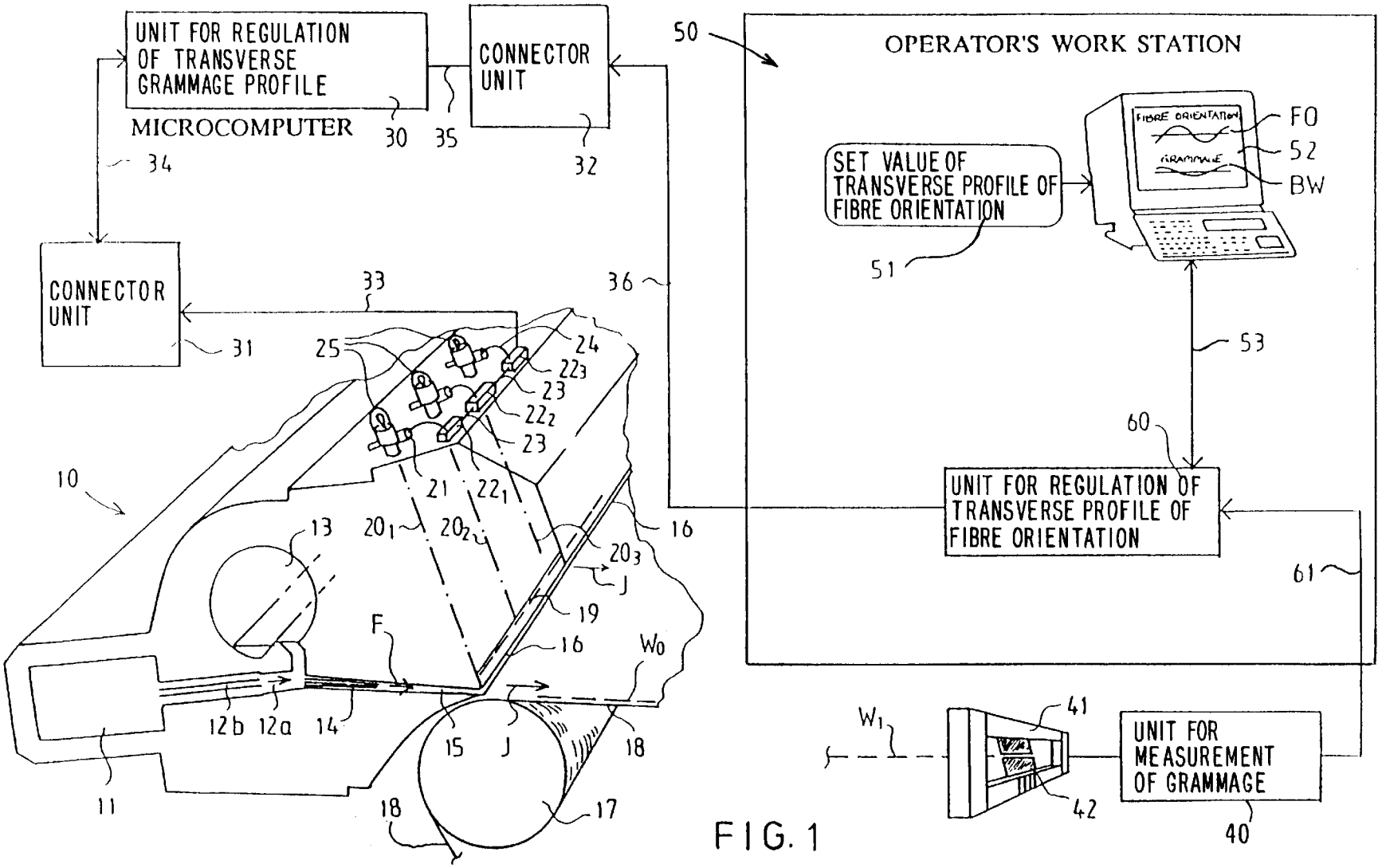

FIG. 1 is a schematic illustration of an exemplifying embodiment of the regulation method and system in accordance with the invention. According to FIG. 1, the adjustment spindles $\mathbf{20}_1 \ldots \mathbf{20}_N$ of the discharge opening 16 of the headbox 10 of the paper machine are regulated so that a suitable transverse profile is obtained for the pulp web $W_0$ formed out of the pulp jet J discharged through the discharge opening 16 onto the fourdrinier wire 18 running over the breast roll 17. The same paper machine includes a unit for measuring the grammage of the dried web $W_1$, placed after its drying section (not shown), from which unit a measurement signal is passed via the conductor 61 to the unit 60 for regulation of the transverse profile of fibre orientation. The method and system in accordance with the invention is carried out in the block 50, which includes the operator's work station computer 52, on whose monitor screen the transverse fibre-orientation profile FO and the corresponding grammage profile BW of the web $W_1$ are shown. The set value unit 51 for the transverse profile of fibre orientation is connected to the operator's work station computer 52.

From the regulation unit 60 consisting of the computer, a regulation signal is passed via the conductor 36 and the connector unit 32 as well as via the conductor 35 to the regulation unit 30 for transverse grammage profile, said unit 30 consisting of a microcomputer. From the regulation unit 30, a regulation signal is passed via the conductor 34 to the connector unit 31, which regulates the series of adjustment spindles $\mathbf{20}_1 \ldots \mathbf{20}_N$ of the headbox 10 via the conductor 33.

The headbox 10 shown in FIG. 1 is primarily known in the prior art, and, starting from the discharge opening 16, in the direction opposite to the direction of flow F of the pulp suspension, it comprises first the discharge duct 15, then the turbulence generator 14, the stilling chamber 12*a*, the set of distributor pipes 12*b*, and the distributor beam 11. In a known manner, the profile bar 19 is attached to the front wall of the upper lip beam of the discharge duct 15, said profile bar determining the profile of the discharge opening 16 and, thereby, the transverse profile of the pulp jet J.

The profile bar 19 is attached to the adjustment spindles $\mathbf{20}_1 \ldots \mathbf{20}_N$. If the spindles 20 are placed at distances of, e.g., 10 cm from each other, a paper machine of a width of about 8 m includes 80 individual adjustment spindles (N=80). Each adjustment spindle 20 is connected to an angle gear 25. Between each spindle 20 and gear 25 is a stepping motor 21 which displaces a spindle 20 in its longitudinal direction. Each individual angle-gear/stepping-motor unit 21,25 communicates, via a cable 24 with a preferably intelligent, actuator controller $\mathbf{22}_1 \ldots \mathbf{22}_N$ of its own. Said controllers $\mathbf{22}_1 \ldots \mathbf{22}_N$ are identical with each other, and one advantageous exemplifying embodiment thereof is described in more detail in the applicant's FI Patent Application No. 892670 (filed Jun. 1, 1989). The various actuator controllers 22 are connected to a common cable 33, which is provided with a part 23 having a rake-like division.

The intelligent actuator controllers 22, are identical to each other and typically number N pcs. where N=10 . . . 100, each operate as independent positioning devices, which also monitor their own operations in real time. The cable 33 and its rake part 23 form a part of the serial bus so that the amount of simultaneous operations is limited only by the speed of data transfer or by the capacity of the power source.

FIG. 1 shows the measurement unit 40 for the grammage profile of the web W, wherein, in connection with a set of measurement beams 41 and with a carriage 42 transversing on said set of beams, there is a detector for measurement of the grammage profile of the web, from which detector a measurement signal is obtained via the conductor 61, said signal being passed to the measurement and regulation unit 60.

The following describes the mathematical foundations of the method and system of the invention as well as, in relation to them, the various steps of the regulation method of the invention and the progress of the regulation algorithm from one step to the other.

Step 1 Data concerning the relationship between the fibre orientation θ(x) and the grammage M(x) of the web in the paper machine are collected in a database to be stored in the memory of the operator's work station computer 52 by carrying out response runs, which will be described in more detail below. As used herein, a response run means changing the state of the paper machine from a first state into a second state. A response file, consisting of $\theta_i(x)$ and $M_i(x)$, the fibre orientation and a grammage of the paper a distance x from the edge of the paper web W when the paper machine is in the state i,i=1,2 is stored.

Step 2 In order to obtain statistical significance, a sufficient number of response files are acquired for effecting regulation of the paper machine. Let $\theta_i^j(x)$ and $M_i^j(x)$ be the fibre orientation and the grammage obtained from the response run j in the state i of the paper machine.

Step 3 The changes are calculated for the grammage and fibre orientation of the paper as follows:

$$\Delta M^j(x)=M_1^j(x)-M_2^j(x) \text{ and } \Delta\theta_j(x)=\theta_1^j(x)-\theta_2^j(x). \tag{1}$$

Step 4 The change $\Delta\theta^j(x)$ in fibre orientation depends on the change in $\Delta M^j(x)$ grammage as follows:

$$\mathcal{F}\left(\frac{\partial\Delta\theta^j(X)}{\partial x}\right)\cdot\gamma^j = \mathcal{F}(\Delta M^j(X)) \tag{2}$$

wherein $\mathcal{F}$ is Fourier-transform operator x is distance from edge of paper web $\gamma^j$ is a factor dependent on wavelength which is an unknown, determined by solving the equation (2).

Step 5 The solution $\gamma^j$ of equation (2) does not depend on the variable x. In such a case $\gamma^j$ can be solved from the group of equations $$\begin{pmatrix} \alpha_1^j & O & \ldots & O \\ O & \alpha_2^j & \ldots & O \\ \cdot & \cdot & \cdot & \cdot \\ \cdot & \cdot & \cdot & \cdot \\ \cdot & \cdot & \cdot & \cdot \\ O & O & \ldots & \alpha_{2m}^j \end{pmatrix} \cdot \begin{pmatrix} \gamma_1^j \\ \gamma_2^j \\ \cdot \\ \cdot \\ \cdot \\ \gamma_{2m}^j \end{pmatrix} = \begin{pmatrix} \beta_1^j \\ \beta_2^j \\ \cdot \\ \cdot \\ \cdot \\ \beta_{2m}^j \end{pmatrix} \tag{3}$$

wherein $\alpha_i^j$ and $\beta_i^j$, i=1, . . . ,2m are Fourier coefficients of the left side and of the right side of the equation (2).

Step 6 To improve the statistics, the coefficients $\gamma^{opt}$ are solved so that they are optimized to produce the lowest, mean square error for many of the response files $j=j_1, \ldots, j_n$ obtained in Step 2 of the relationship (2). I.e.:

$$\gamma^{opt} = \arg \min_{\substack{-\epsilon\leq\gamma_i\leq\epsilon \\ i=1,\ldots,2n}} \frac{1}{2}\|\tilde{A}\gamma-\tilde{B}\|^2 \tag{4}$$

wherein $$\tilde{A} = \begin{pmatrix} \alpha_1^{j1} & O & \ldots & O \\ O & \alpha_1^{j1} & \ldots & O \\ \cdot & \cdot & \cdot & \cdot \\ \cdot & \cdot & \cdot & \cdot \\ \cdot & \cdot & \cdot & \cdot \\ O & O & \ldots & \alpha_{2m}^{j1} \\ \cdot & \cdot & \cdot & \cdot \\ \cdot & \cdot & \cdot & \cdot \\ \cdot & \cdot & \cdot & \cdot \\ \alpha_1^{jn} & O & \ldots & O \\ O & \alpha_2^{jn} & \ldots & O \\ \cdot & \cdot & \cdot & \cdot \\ \cdot & \cdot & \cdot & \cdot \\ \cdot & \cdot & \cdot & \cdot \\ O & O & \ldots & \alpha_{2m}^{jn} \end{pmatrix} = \begin{pmatrix} \beta_1^{j1} \\ \beta_2^{j1} \\ \cdot \\ \cdot \\ \cdot \\ \beta_{2m}^{j1} \\ \cdot \\ \cdot \\ \cdot \\ \beta_1^{jn} \\ \beta_2^{jn} \\ \cdot \\ \cdot \\ \cdot \\ \beta_{2m}^{jn} \end{pmatrix}$$

and ϵ and −ϵ mean the upper limit and the lower limit of the coefficients $\gamma_i$.

Step 7 The error $\Delta\theta(x)$ in the fibre orientation is corrected by adjusting the target profile of grammage. The change $\Delta M(x)$ in the target profile is calculated as follows:

(i) the vector $B=(\beta_1, \ldots, \beta_{2m})^T$ is determined from the equation $$B = \begin{pmatrix} \alpha_1 & O & \ldots & O \\ O & \alpha_2 & \ldots & O \\ \cdot & \cdot & \cdot & \cdot \\ \cdot & \cdot & \cdot & \cdot \\ \cdot & \cdot & \cdot & \cdot \\ O & O & \ldots & \alpha_{2m} \end{pmatrix} \cdot \begin{pmatrix} \gamma_1^{opt} \\ \gamma_2^{opt} \\ \cdot \\ \cdot \\ \cdot \\ \gamma_{2m}^{opt} \end{pmatrix} \tag{5}$$

(ii) The change $\Delta M(x)$ in the target profile of grammage is calculated from the equation $$\Delta M(X) = \sum_{i=1}^{2m} \beta_i c_i \tag{6}$$

wherein the factors $c_i$ are components of the vector $$C = \begin{pmatrix} \cos x \\ \cos 2x \\ \cdot \\ \cdot \\ \cdot \\ \cos mx \\ \sin x \\ \sin 2x \\ \cdot \\ \cdot \\ \cdot \\ \sin mx \end{pmatrix} \tag{7}$$

In relation to the above noted formulae, it can be ascertained that, according to the invention, when expressed mathematically, the on-line measurement of fibre orientation can be carried out as follows:

(i) The coefficients $\alpha_i$, i=1, . . . ,2m are identified by means of the equation (5) (B and $\gamma_i^{opt}$, i=1, . . . ,2m are now known).

(ii) The change $\Delta\theta(x)$ in fibre orientation is determined from the equation $$\Delta\theta(x) = \sum_{i=1}^{2m} \alpha_i c_i \tag{8}$$

The calculation algorithms corresponding to the above equations (1) . . . (8) are included as a part in the computer software which carries out the orientation-measurement and regulation program, which is stored in the memory of the microcomputer 52 of the operator's work station 50, and which will be described below. The calculation algorithms corresponding to the equations (1) . . . (8) can be programmed by a person skilled in the art on the basis of ordinary professional knowledge, for which reason it is not considered necessary to explain them in detail.

Figure 2A:
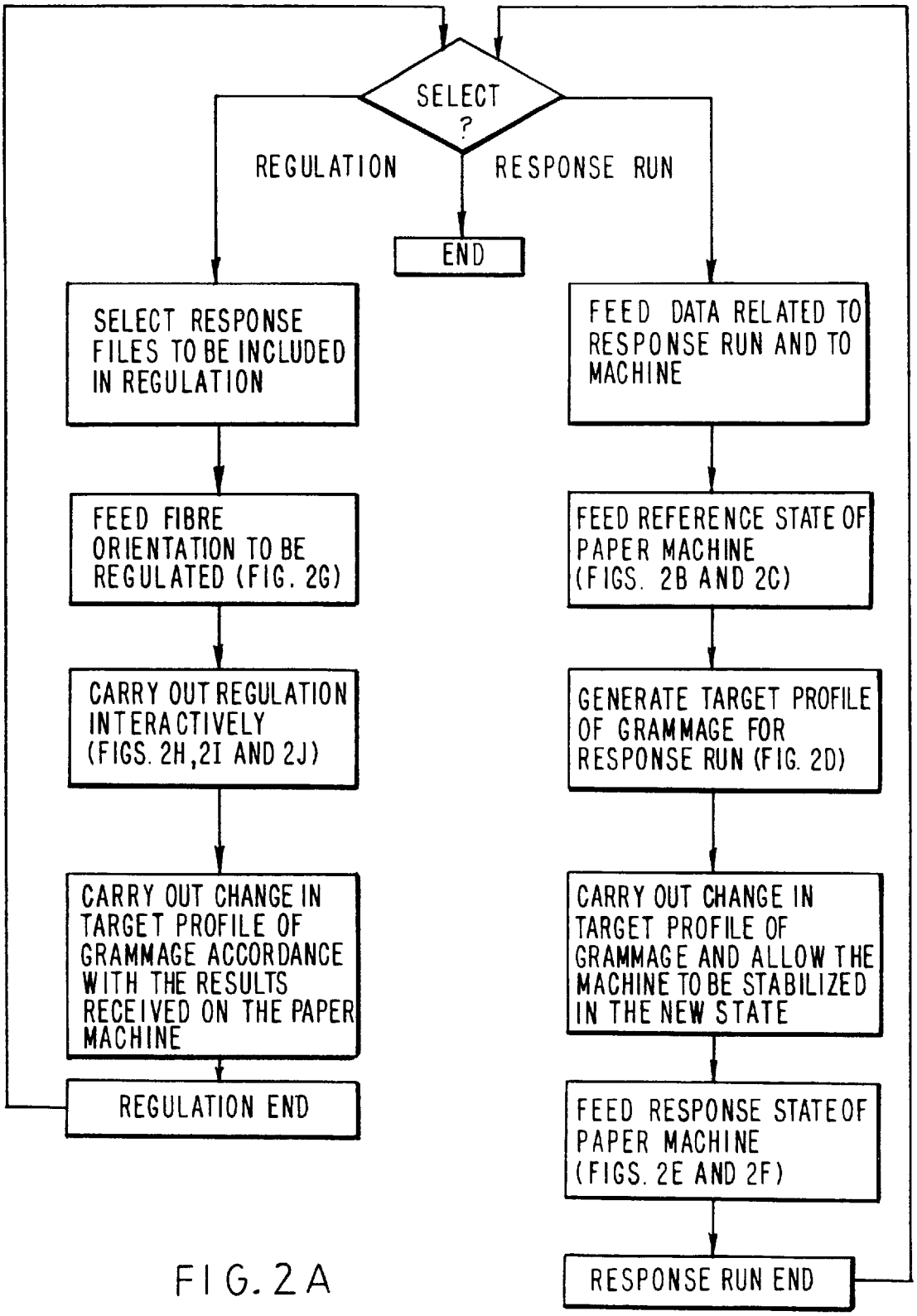
FIG. 2A illustrates a flow chart of a response-run and regulation program applied in the method of the invention.

FIG. 2A illustrates the flow diagram of the software intended for carrying out the on-line orientation measurement and regulation program, stored in the memory of the microcomputer 52 of the operator's work station 50. Upon starting of the software, on the display screen of the microcomputer 52 a menu is obtained from which it is possible to choose "response run", "regulation", or "end". When "response run" is chosen, an inquiry screen appears on a display in relation to which the data related to the response run and to the machine are fed, such as the name of the response run, the date, width of edge strip, paper width, number of grammage measurement detectors, pulp jet ratio, and wire 18 speed of the paper machine, as well as speed of the reel-up of the paper machine.

Figure 2B:
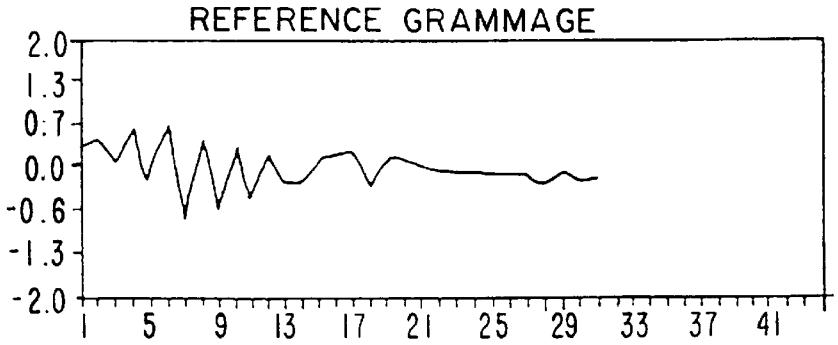
FIGS. 2B, 2C, 2D, 2E and 2F show examples of some typical grammage and fibre-orientation profiles that occur in connection with response runs carried out with a paper machine in accordance with the invention.
Figure 2C:
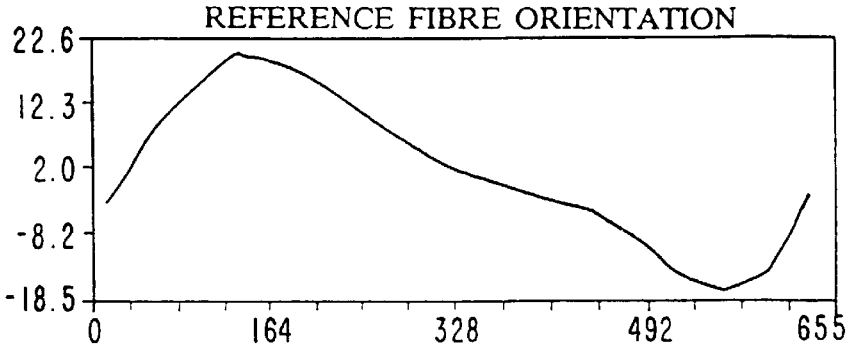
Figure 2D:
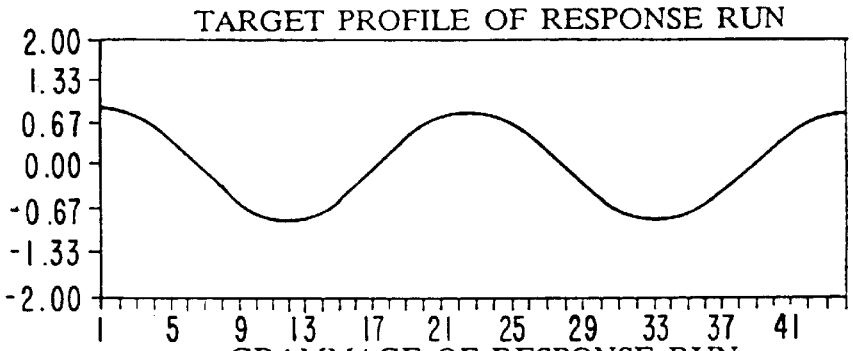
Figure 2E:
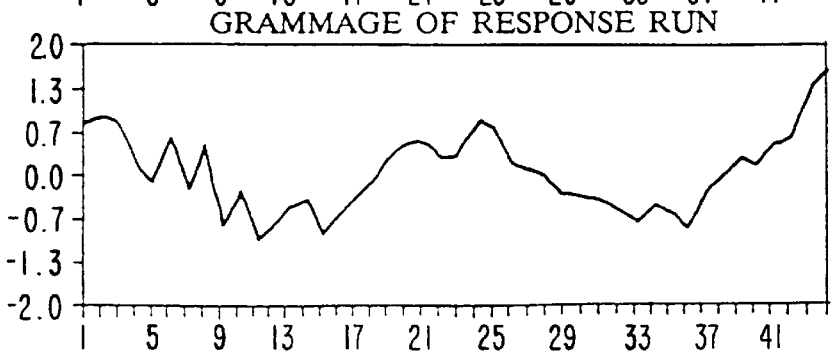
Figure 2F:
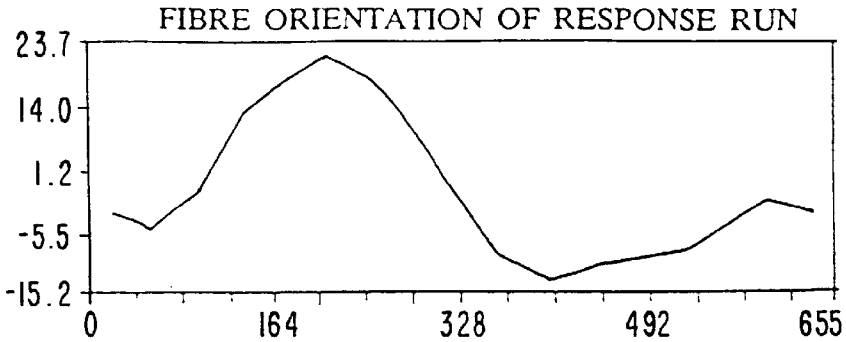
Figure 2G:
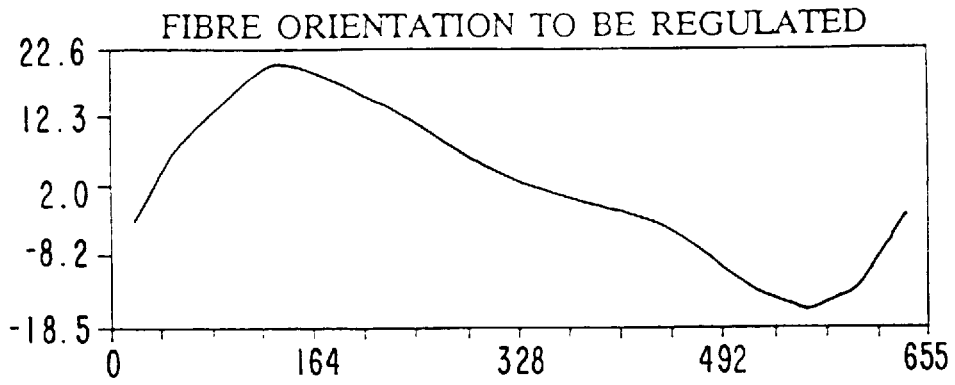
Figure 2H:
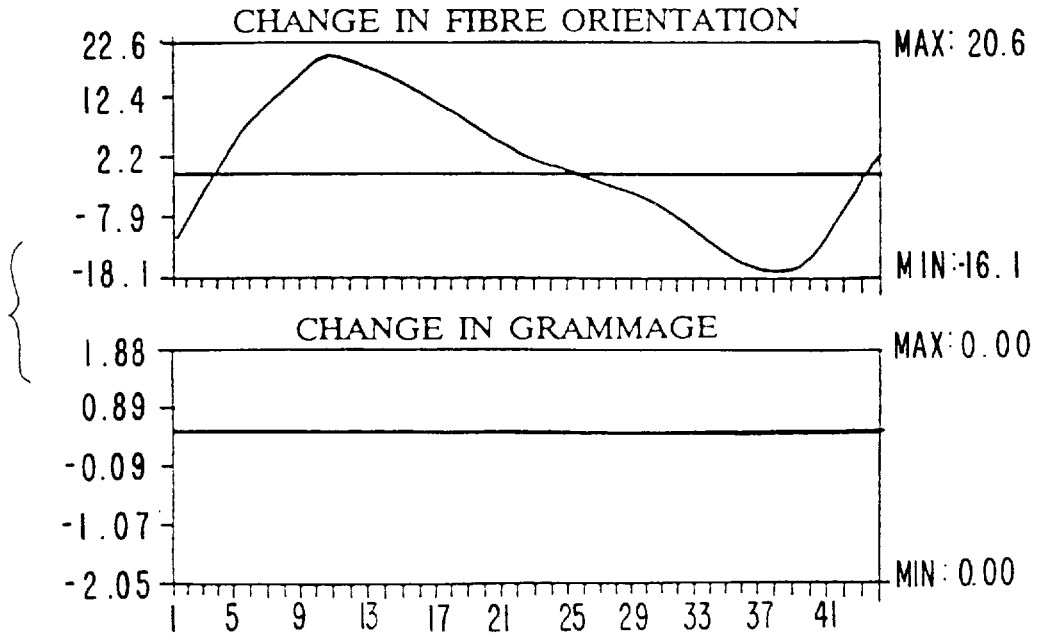
Figure 21:
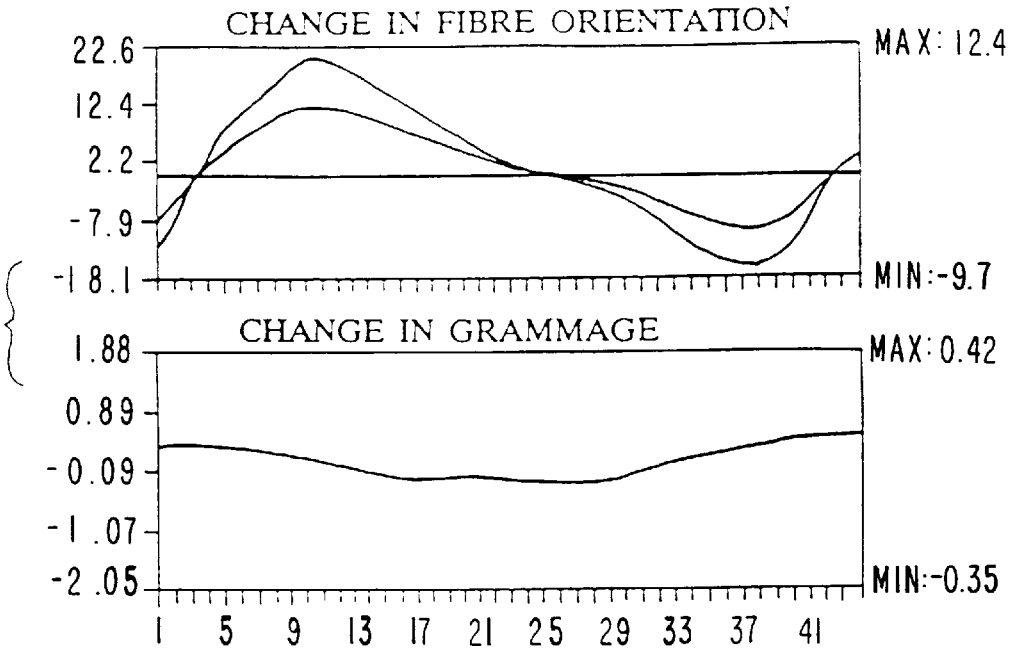
Figure 2J:
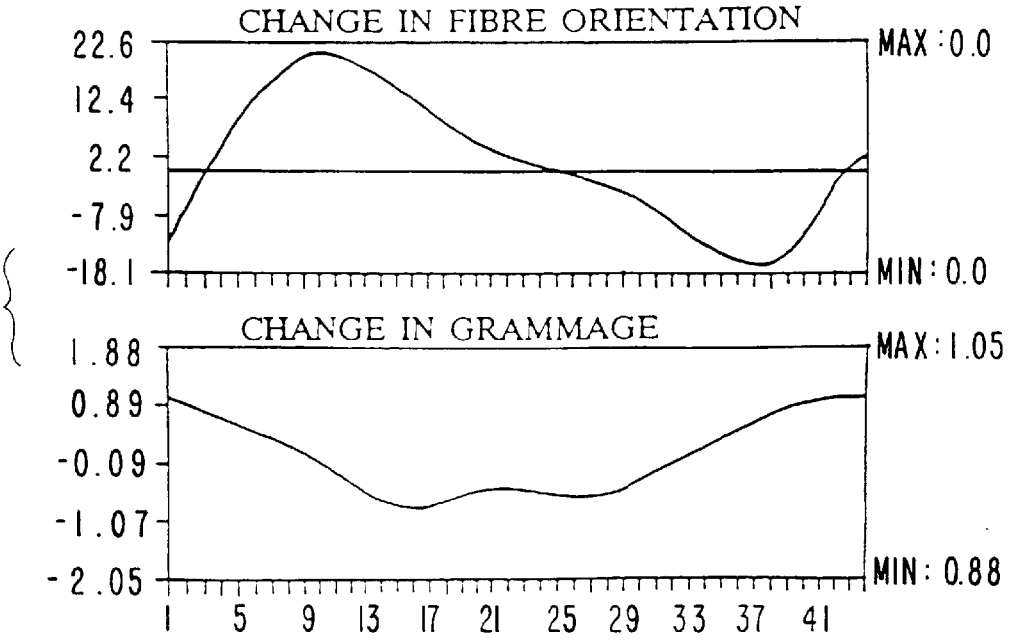

Thereafter an inquiry screen appears, in relation to which the reference state of the paper machine is fed, i.e. reference grammage distribution (FIG. 2B) and reference fibre-orientation distribution (FIG. 2C). The reference profile of fibre orientation is measured in the laboratory from paper samples taken from different locations in the transverse direction of the paper web by means of known methods for measurement of fibre orientation. In the next stage, the target profile of grammage is generated for the response run (FIG. 2D), whereupon a change in the target profile of grammage is carried out, and the machine is allowed to be stabilized in the new state. Thereafter the response state of the paper machine is input (FIGS. 2E and 2F), which comprises the grammage profile of the response run and the fibre-orientation profile of the response run. This program branch terminates at the end of the response run, returning the user to the initial display menu as shown in FIG. 2A.

In accordance with FIG. 2A, a response run is performed using the running and quality parameters in the paper machine. The program regulation branch is chosen, wherein, in the first inquiry screen, the response files to be included in the regulation are selected from those, which were formed in the response runs in the manner described above. Moreover, if necessary, the machine asks for further data concerning the paper machine, such as headbox width, number (N) of adjustment spindles (20), and spacing of spindles. Thereafter the fibre orientation profile to be regulated is input. In the next stage of the program, the regulation is carried out interactively.

To reach the final state, the program asks for the change in the target profile of grammage in accordance with the results received from the paper machine. The next step is to end the regulation, whereupon one returns to the initial display menu.

Figure 3A:
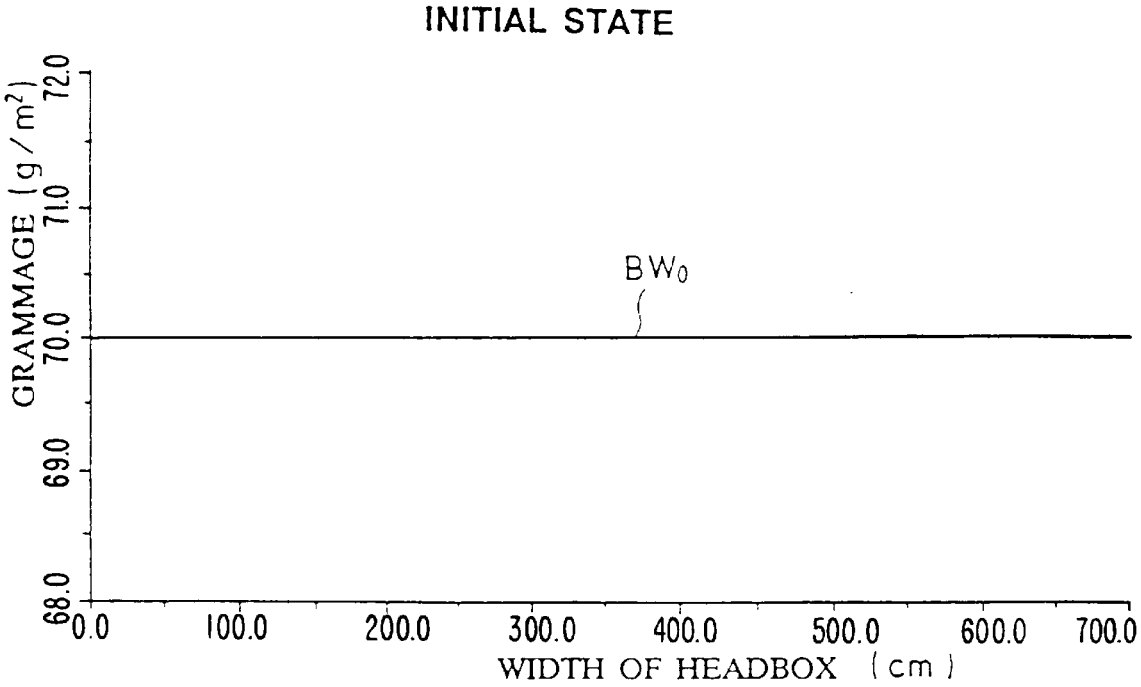
FIGS. 3A and 3B show correspondence between grammage (FIG. 3A) and fibre-orientation profiles (FIG. 3B) in the initial stage of the regulation.
Figure 3B:
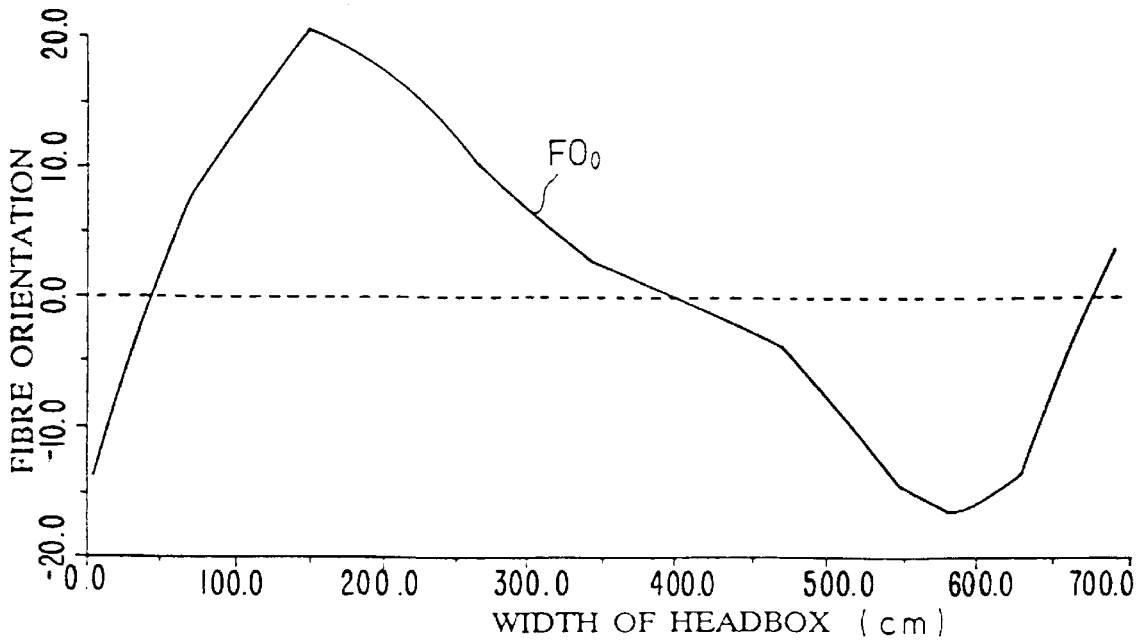
Figure 4A:
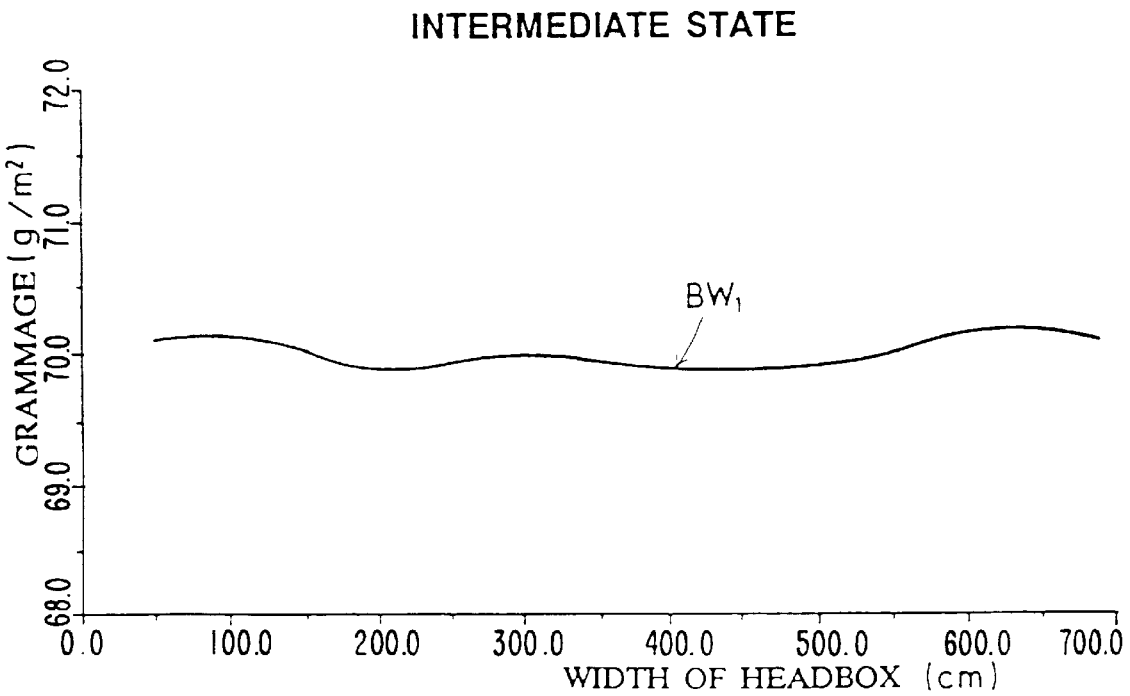
FIGS. 4A and 4B show the correspondence between the grammage (FIG. 4A) and fibre-orientation profiles (FIG. 4B) in the intermediate stage of regulation.
Figure 4B:
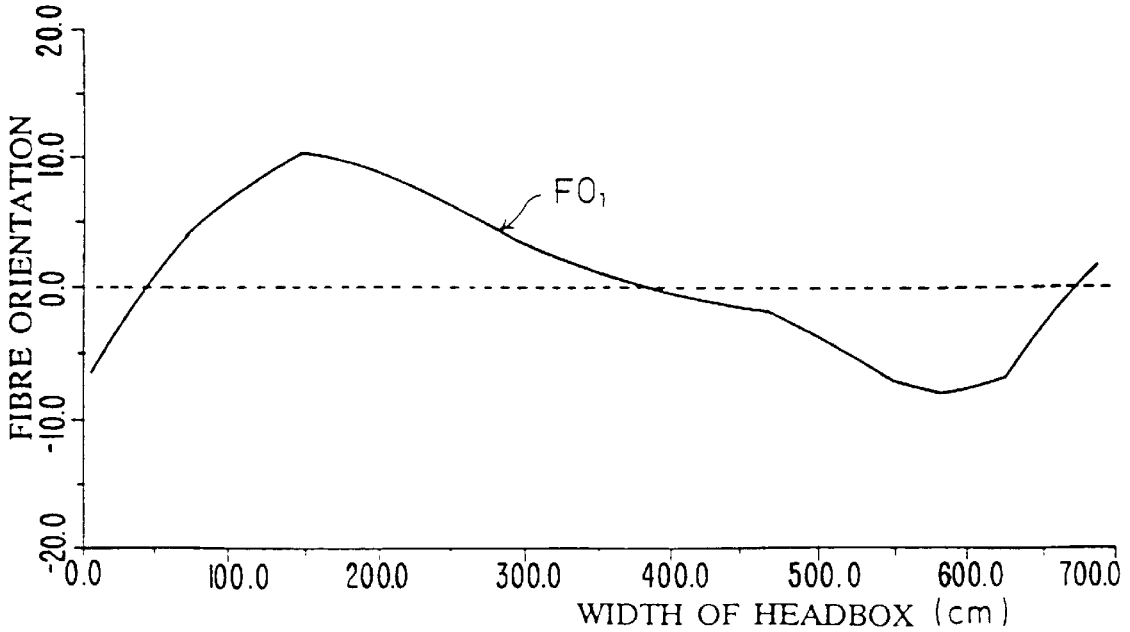

Different stages in carrying out the regulation are also illustrated by the initial state with the grammage profile $BW_0$ and fibre-orientation profile $FO_0$ shown in FIGS. 3A and 3B, by the intermediate stage with the grammage profile $BW_1$ and fibre-orientation profile $FO_1$, and by the corresponding final-state profiles $BW_2$ and $FO_2$.

Figure 5A:
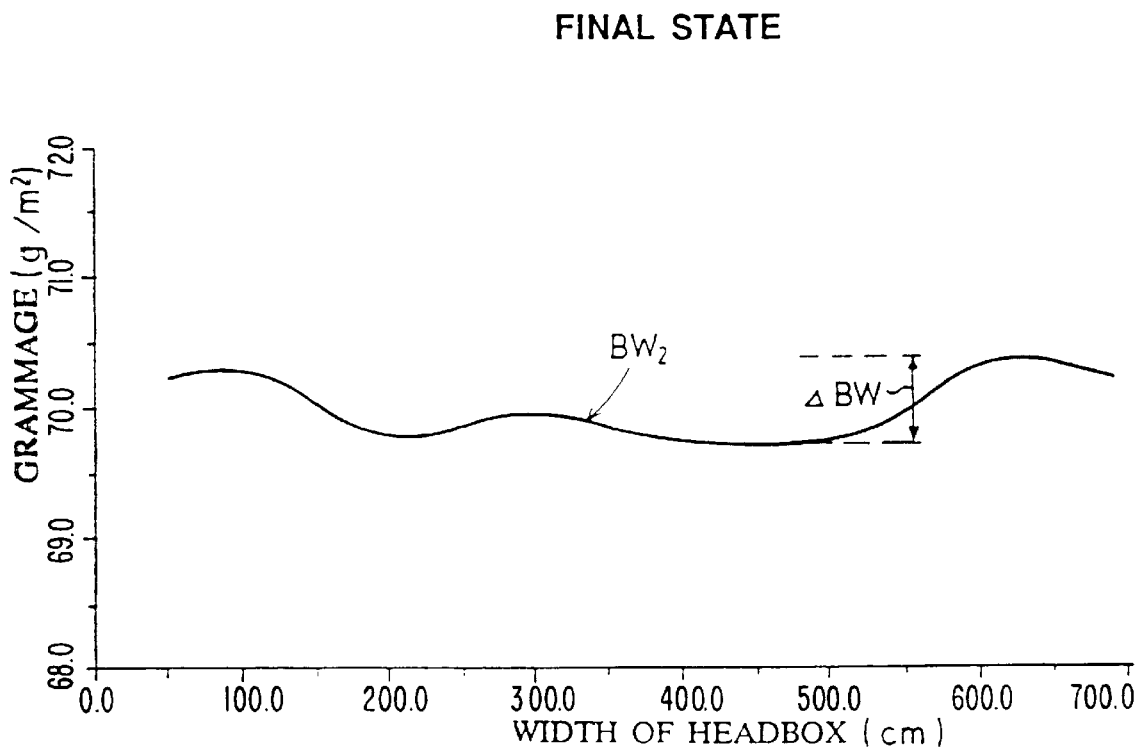
FIGS. 5A and 5B show correspondence between the grammage (FIG. 5A) and fibre-orientation profiles (5B) in the final state of regulation.
Figure 5B:
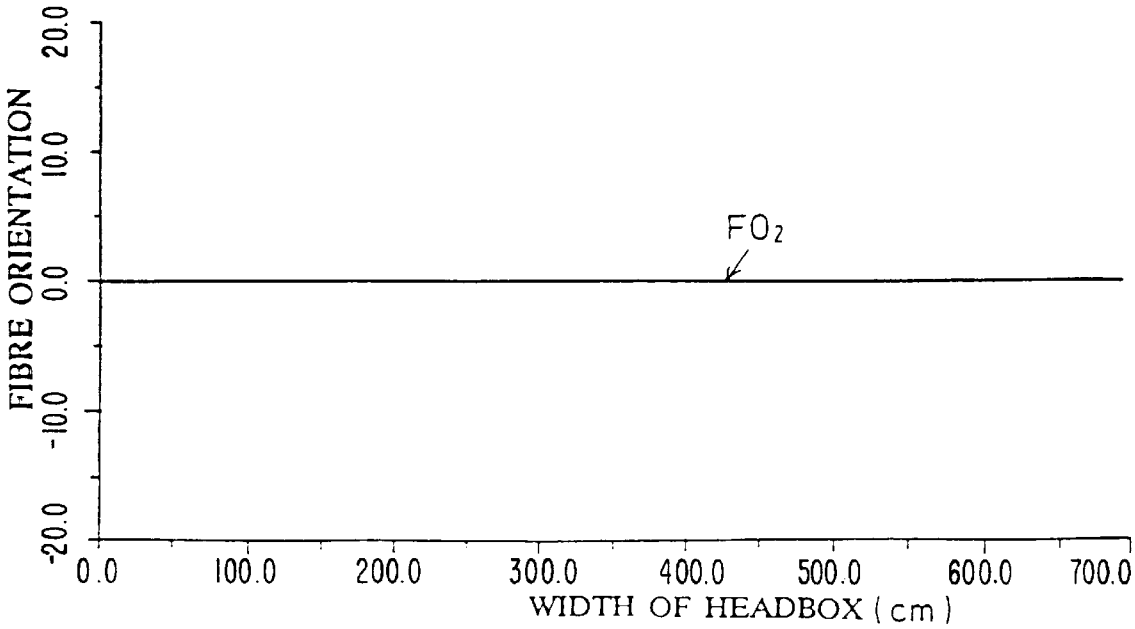

In the following, the final state of the property profiles carried into effect by means of the regulation system and software (FIG. 2A) and equations (1) . . . (8) described above will be examined briefly. FIG. 5A shows that the final state of the grammage profile $BW_2$ is not entirely even, but between its minimum and maximum there is a different $\Delta BW$, which represents a maximal change of about 1% in the grammage profile, which is, as a rule, clearly within the permitted quality criteria. According to FIG. 5B, an even profile $FO_2$ of fibre orientation has been obtained for the web W.

It is advisable to repeat the response runs described above at certain intervals, and at least when substantial changes take place in the paper quality produced, in its raw-material, or in the running parameters of the paper machine, such as the speed.

In the following, the various details of the invention may be modified within the scope of the invention, which is properly delineated by the appended claims and the details of the preferred embodiment are described above for the sake of example only.

We claim:

1. A method for regulating the transverse distribution of the fibre orientation of a web produced by a paper machine having transverse pulp flows in a region of a discharge opening (16) of a headbox (1) of the paper machine, wherein the transverse grammage profile of the paper web ($W_0 \ldots W_1$) produced by means of the paper machine is measured, the measurement signal of the transverse grammage profile being used as a feedback signal in the control of the transverse profile of the discharge opening, for regulating the transverse fiber orientation profile of the web, comprising:

(a) collecting a machine configuration and machine parameters at each particular time present in the paper machine to be controlled defining states of operation, and relation data concerning a relationship between a transverse distribution of fibre orientation $\theta(x)^i$ and a transverse distribution of grammage $M(x)^i$ of the web ($W_0 \ldots W_1$) that is being produced by the paper machine, by carrying out response runs in various states of operation (i);

(b) storing the relation data obtained in said collecting step in a memory of a computer (52) of the control of the paper machine; and (c) regulating the transverse distribution of the fibre orientation of the web by solely controlling the transverse profile of the discharge opening of the headbox wherein the transverse profile of the discharge opening is controlled in accordance with said relation data so as to modify the transverse pulp flows to achieve the desired transverse distribution of the fibre orientation.

2. The method according to claim 1, wherein the response runs of the paper machine comprise the steps, carried out in accordance with a predetermined program stored in memory of the computer:

(a) feeding data relating to the response run and the web into the computer;

(b) feeding reference state data of the paper machine into the computer;

(c) generating, based on the data fed into the computer a target profile of grammage for the response run;

(d) changing the target profile of grammage and allowing the paper machine to stabilize in a new state;

(e) feeding response state data of the paper machine in the new state into the computer; and (f) ending the response run.

3. The method according to claim 2, wherein the regulation step is carried out in accordance with a predetermined program stored in the memory of the computer of the control of the paper machine, comprising:

(a) choosing the response files, obtained from the response runs, to be included in the regulation;

(b) feeding the fibre orientation to be regulated into the computer;

(c) interactively regulating the fibre orientation;

(d) changing the target profile of grammage in accordance with the desired transverse distribution of fibre orientation; and (e) ending the regulating step.

4. The method according to claim 1 further comprising the steps of:

(a) acquiring a sufficient number of response files in a database for effective regulation, and calculating changes for grammage and fibre orientation of the paper web;

(b) formulating an an equation relating the change in fibre orientation, the change in grammage and a factor dependant on wavelength, and then solving the equation so that the solutions of the equation are optimized to produce the lowest mean square error;

(c) calculating a change in target profile of grammage (is calculated) based on the measured grammage; and (d) correcting error in the fibre orientation by adjusting the target profile of grammage in accordance with said calculated change in target profile.

5. The method according to claim 1, wherein the step of controlling the tranverse profile of the headbox of the paper machine further comprises a step of adjusting the transverse profile of the discharge opening of the headbox of the paper machine by means of adjustment spindles ($\mathbf{20}_1 \ldots \mathbf{20}_N$) which are controlled by the computer (FIG. 1).

6. The method according to claim 5, wherein the step of adjusting the discharge opening of the headbox by means of adjustment spindles ($\mathbf{20}_1 \ldots \mathbf{20}_N$), comprising stepping-motor/-angle-gear assemblies (21, 25).

7. A method for regulating a transverse fiber orientation of a web with respect to an axis of web movement in a paper machine having a headbox having a discharge opening for pulp and a plurality of points of adjustment, the paper machine having transverse pulp flows in a region of the discharge opening, comprising the steps of:

(a) collecting data concerning the relationship between the transverse distribution of fiber orientation of the web with respect to the axis of web movement and the transverse distribution of grammage of the web at a plurality of measurement points in a direction transverse to the movement of the web in the paper machine, in conjunction with data concerning the machine configuration and process parameters at the time of data collection;

(b) processing the collected data to produce a response matrix which relates measured grammage distribution, in a machine configuration with a set of process parameters, and the transverse fiber orientation distribution;

(c) storing the response matrix;

(d) measuring the grammage of the web at a given time of operation of the paper machine to obtain real-time data relating to the grammage at a plurality of measurement points in the transverse direction with respect to the movement of the web;

(e) processing the real-time data relating to the grammage at the time of operation in accordance with the stored response matrix to generate a predicted transverse grammage profile correction necessary in order to obtain a desired transverse fiber orientation distribution; and (f) regulating the transverse fibre orientation of the web by solely controlling the transverse profile of the discharge opening of the headbox of the paper machine wherein the transverse profile of the discharge opening of the headbox of the paper machine is controlled by adjusting at least one of the plurality of adjustment points at the discharge opening, at the time of operation, in accordance with the predicted transverse grammage profile correction necessary to obtain the desired transverse fiber orientation distribution, so that any perturbation from a desired transverse fiber orientation distribution at the time of operation may be corrected by means of a feedback control based on the real-time data relating to the grammage obtained at time of operation of the paper machine.

8. The method according to claim 7, wherein said data collection step comprises:

(a) controlling the paper machine with a computer based controller, said computer having a predetermined program for receiving data related to at least type of paper web to be manufactured, state of the paper machine and transverse distribution of grammage;

(b) running the paper machine at a target transverse grammage profile, and collecting data relating to transverse distribution of grammage;

(c) changing the target transverse grammage profile to a new target transverse grammage profile;

(d) allowing the paper machine to stabilize at the new target transverse grammage profile; and (e) running the paper machine at the new target transverse grammage profile, and collecting data relating to transverse distribution of grammage.

9. The method according to claim 8, wherein said processing the collected data step further comprises inputting operating parameters of the paper machine and the measured grammage of the web, and selecting from said stored response matrix a set of values representing an operating point of the paper machine with respect to at least type of paper being manufactured and machine configuration, and said regulating step further comprises adjusting at least one of the plurality of adjustment points at the discharge opening, at the time of operation, in accordance with the selected values representing the operating point.

10. The method according to claim 7, wherein said regulating step is conducted to obtain a uniform transverse fiber orientation distribution while simultaneously minimizing deviations in the transverse distribution of grammage.

11. The method according to claim 7, wherein said regulating step comprises manipulating at least one adjustment spindle associated with an adjustment point, at the time of operation.

12. The method according to claim 11, wherein the adjustment spindles are controlled by actuators in response to an actuator control unit which generates signals related to the predicted transverse grammage profile correction necessary.

13. The method according to claim 7, wherein at least one of the adjustment points is associated with a stepping motor operatively mounted for regulating the transverse profile of the discharge opening.

14. The method according to claim 7, wherein said processing the collected data step comprises transforming the collected data, for each of a plurality of machine states of operation, such that the transformed data is dependant on a harmonic wavelength and independent of the transverse distance across the web, so that the transformed data relates a change in fiber orientation with a change in grammage, and said processing the data step comprises using the transformed data to determine a change in the discharge opening required to obtain a desired transverse fiber orientation distribution, based on the measured transverse grammage profile.

15. The method according to claim 7, wherein a sufficient amount of data is collected in said collecting step so that a statistically optimized coefficient may be calculated in said processing the collected data step for formulating a relationship between the transverse distribution of fiber orientation and the transverse distribution of grammage of the web.

16. The method according to claim 15, wherein a plurality of data measurements are obtained for similar machine operating states, said method further comprising the step of optimizing the response matrix based on the plurality of data measurements.

17. The method according to claim 7, wherein the points of adjustment are spaced 10 cm apart.

18. The method according to claim 17, wherein there are between 10 and 100 points of adjustment.

19. The method according to claim 18, wherein there are 80 points of adjustment, each of which is spaced 10 cm apart and controlled by a separate actuator.

20. A method for regulating the transverse distribution of the fibre orientation of a web produced by a paper machine having transverse pulp flows in a region of a discharge opening (16) of a headbox (10) of the paper machine, comprising the steps of: measuring the transverse grammage profile of the paper web ($W_0 \ldots W_1$) produced by means of the paper machine; collecting a machine configuration and machine parameters at each particular time present in the paper machine to be controlled defining states of operation, and relation data concerning a relationship between a transverse distribution of fibre orientation $\theta(x)^i$ and a transverse distribution of grammage $M(x)^i$ of the web ($W_0 \ldots W_1$) that is being produced by the paper machine, by carrying out response runs in various states of operation (i); storing the relation data obtained in said collecting step in a memory of a computer (52) of a control of the paper machine; and regulating the transverse distribution of the fibre orientation of the web by solely controlling the the transverse profile of the discharge opening of the headbox wherein the transverse profile of the discharge opening is controlled in accordance with said relation data so as to modify the transverse pulp flows to achieve the desired transverse distribution of the fibre orientation.

* * * * *